United States Patent [19]

Guiler

[11] 4,446,603

[45] May 8, 1984

[54] METER CLAMPING RING

[75] Inventor: Richard S. Guiler, Newton, N.J.

[73] Assignee: E. J. Brooks Company, Newark, N.J.

[21] Appl. No.: 356,335

[22] Filed: Mar. 9, 1982

[51] Int. Cl.[3] ..... B65D 63/00

[52] U.S. Cl. ..... 24/21; 24/20 R; 24/24; 24/505

[58] Field of Search ..... 24/17 B, 20 LS, 20 R, 24/21, 24, 25, 20 EE, 268, 270, 272, 274 R, 278, 285, 255 SL, 256, 16 PB, 271, 249 LS, 249 R, 254; 285/408, 413, 415; 248/27.1, 316.1, 231

[56] References Cited

U.S. PATENT DOCUMENTS

| | | | |
|---|---|---|---|
| 907,542 | 12/1908 | Vogel | 24/20 LS |
| 3,086,270 | 4/1963 | Zartler | 24/278 |
| 3,494,072 | 2/1970 | Olson | 24/248 R |
| 4,063,434 | 12/1977 | Moberg | 70/386 |
| 4,128,921 | 12/1978 | Heinze et al. | 285/408 |

FOREIGN PATENT DOCUMENTS

| | | | |
|---|---|---|---|
| 1109959 | 6/1961 | Fed. Rep. of Germany | 24/268 |
| 168630 | 9/1959 | Sweden | 24/24 |

*Primary Examiner*—Robert P. Swiatek
*Assistant Examiner*—John G. Weiss
*Attorney, Agent, or Firm*—Robert E. Ross

[57] ABSTRACT

A meter clamping ring for securing an electric meter housing of the type haing a peripheral mounting flange to a meter socket, comprising a clamping ring having ends with portions adapted to overlap to align lock receiving openings. One end is provided with a housing for enclosing the lock. In one embodiment of the invention, the end portions have cooperating means allowing them to be snapped together into the bolt-receiving position to facilitate assembly of the bolt. Resilient means is provided on the inside of the ring which is dimensioned to be flexed against the meter mounting flange when the ring is assembled to prevent any looseness between the ring and the mounting flange resulting from manufacturing tolerances.

9 Claims, 5 Drawing Figures

METER CLAMPING RING

BACKGROUND OF THE INVENTION

In a commonly used type of electric meter mounting, the meter housing is provided with a mounting ring near the rear end, and the housing is retained on the mounting box by a generally circular clamping ring which is U-shaped in cross section so as to enclose the mounting ring and a mounting flange on the meter housing. The ring is commonly formed of a single piece of metal with the end portions turned radially outwardly to form parallel adjacent ends which are drawn together by a clamping bolt.

To prevent unauthorized persons from removing the ring, it has been common to provide a housing over the ends of the ring, said housing receiving lock means which extends through suitable apertures in the outwardly turned ends of the ring. The lock means retains the housing in place, and the housing prevents access to the clamping bolt.

Although such assemblies are effective in preventing removal of the ring, the components are expensive, and the assembly of the components is time consuming.

SUMMARY OF THE INVENTION

In accordance with this invention, a meter clamping ring is provided with end portions which overlap and are provided with openings positioned to be aligned to receive a locking bolt when the ring is assembled onto a meter and meter box. One of the ends carries an integral housing which surrounds the opening to enclose the assembled bolt to protect it from damage. Resilient means is provided on the inside of the ring which is dimensioned to be compressed against the meter mounting ring when the ring is assembled, to prevent any looseness between the ring and the mounting flanges. In a preferred embodiment of the invention the ring is formed of two halves, hinged together at a position approximately half way between the ends. Means may be provided on the free ends of the ring to enable them to snap together during assembly and retain the ends in a position such that the openings are aligned, to facilitate assembly of the lock bolt.

DESCRIPTION OF THE ILLUSTRATED EMBODIMENT

Figure 1:
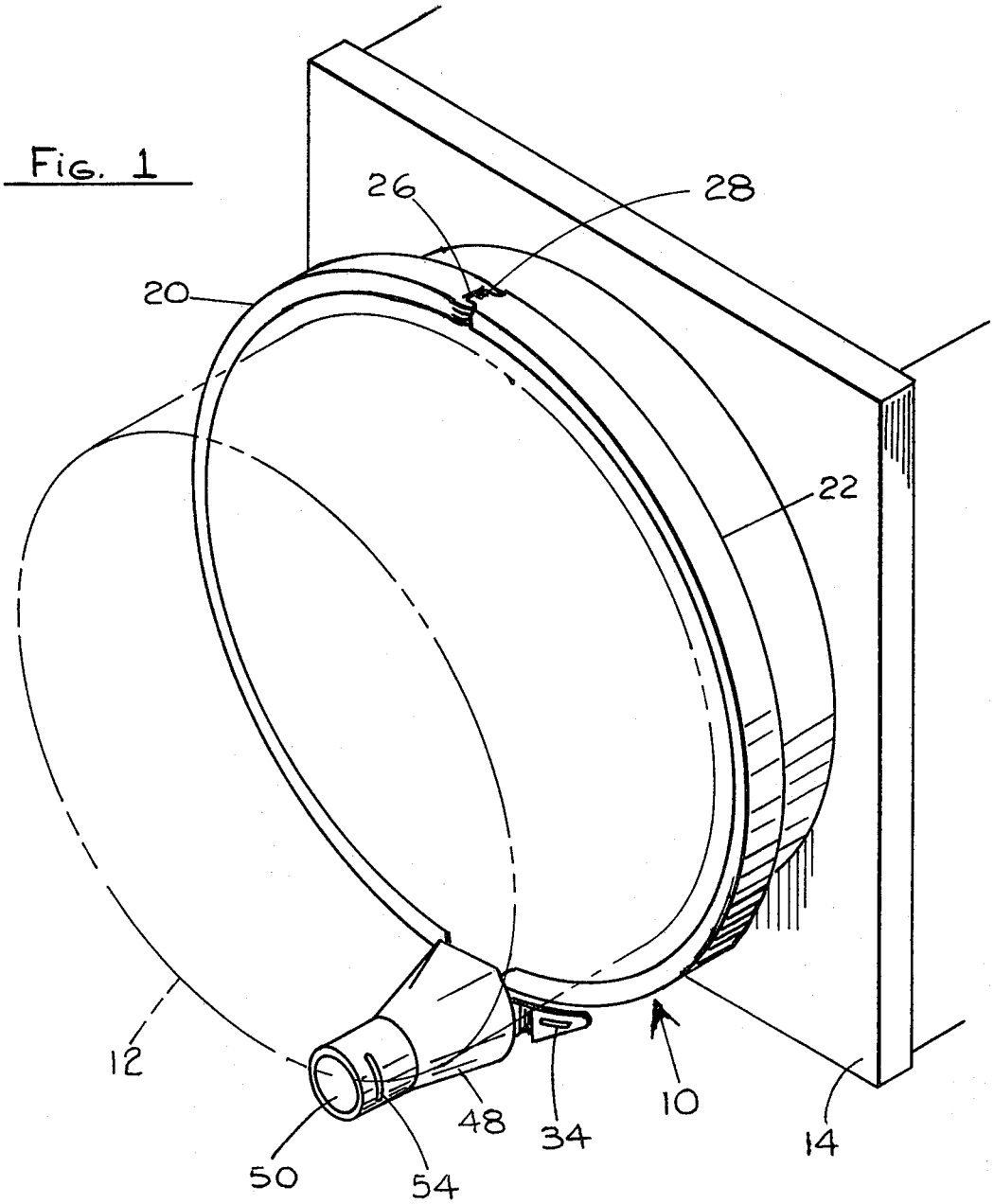
FIG. 1 is a perspective view of a meter clamping ring embodying the features of the invention, assembled with a meter and meter box.
Figure 3:
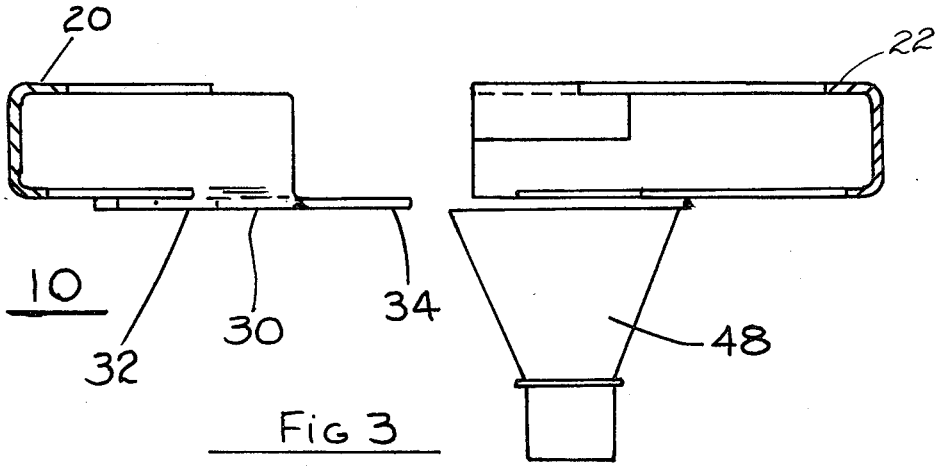
FIG. 3 a top plan view, partly in section, of the ring of FIG. 2.
Figure 2:
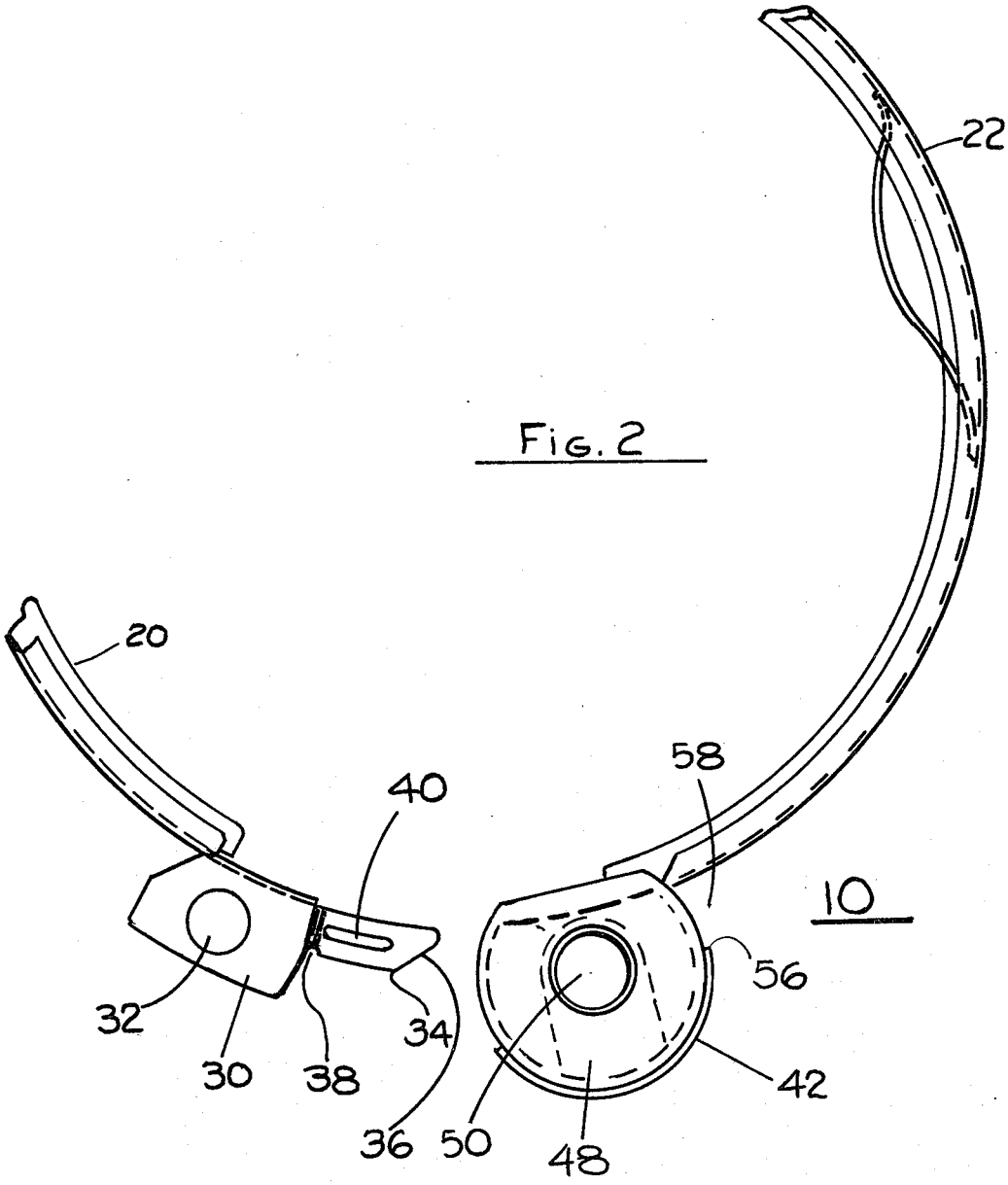
FIG. 2 is a front plan view of the meter clamping ring of FIG. 1, with the upper portion of the ring being omitted.
Figure 5:
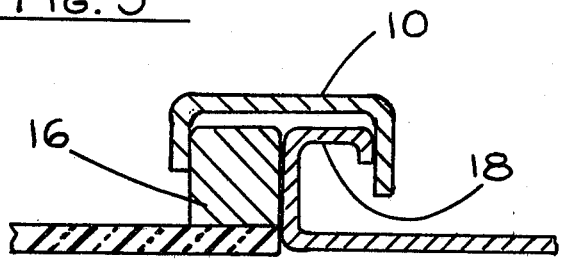
FIG. 5 is a view in side elevation, partly in section, of the ring of FIG. 2.
Figure 4:
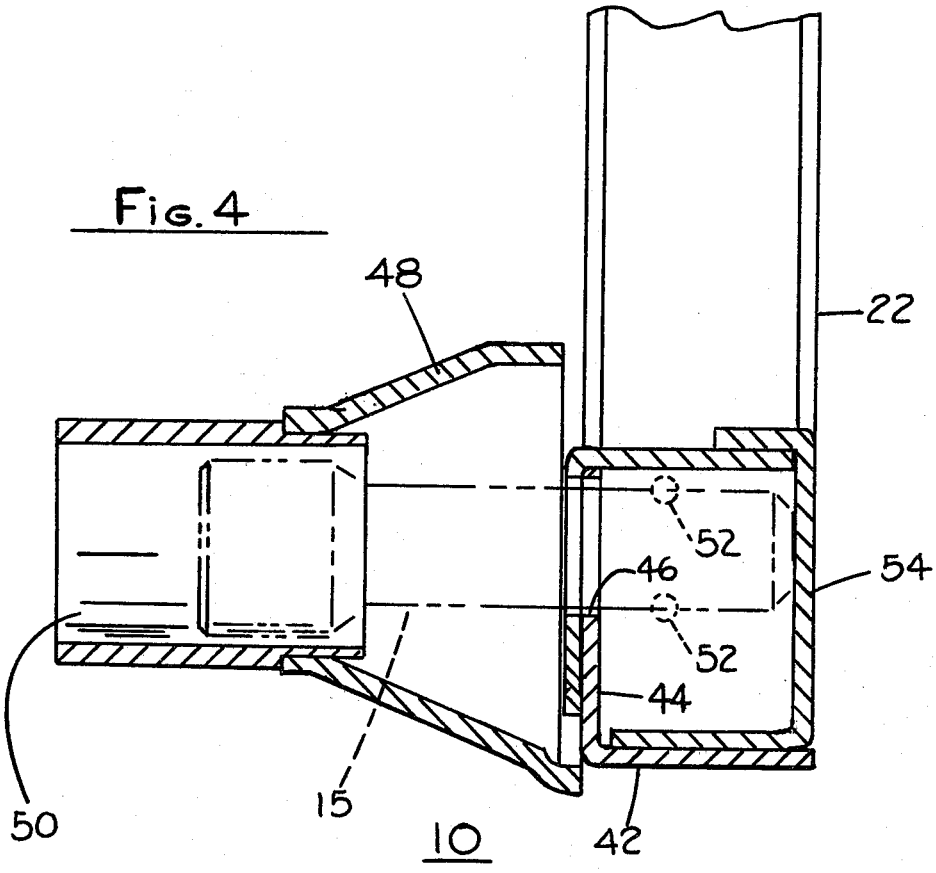
FIG. 4 is a view in section of the ring assembly of FIG. 1, illustrating the lock bolt housing and the position of an assembled lock bolt.

Referring to the drawing, there is illustrated a clamping ring 10 for use in securing an electric meter housing 12 or the like to a meter box 14 by means of a bolt type locking device 15.

The ring is shaped and dimensioned to clamp the mounting flange 16 of the meter housing 12 to a mounting flange 18 on the meter box, and comprises two ring portions 20 and 22 which are generally U-shaped in cross-section and are joined at the upper ends by hinge means which in the illustrated embodiment comprises a slot 26 in the upper end of the portion 20 and a tongue 28 on the upper end of portion 22.

The free or lower ends of the ring portions have overlapping portions for inter-engagement and for receiving the locking device 15. The ring portion 20 has an extended lower end with a blade-like member 30 having an opening 32 depending therefrom, and a tongue 34 extending from the member 30. The tongue 34 has a beveled lower surface 36 on the forward end, and a notch 38 in the lower surface at the rear end. A medial slot 40 is provided to receive a seal (not shown).

The lower end of ring portion 22 is formed into a semi-circular housing support 42 with an upstanding member 44 in which a lock-receiving opening 46 is disposed. A housing 48 is secured to the semi-circular portion 42 and extends forwardly from the plane of the ring. The housing 48 has a central cavity 50 to receive the lock 15, said lock being of the type having a pair of retractable locking elements 52 near one end. The lock 15 is operated by an internal plunger (not shown) which is accessible from the front face of the lock. Such locks are well known in the art. One type of lock suitable for use in the assembly of this invention is disclosed and claimed in U.S. Pat. No. 4,063,434 issued Dec. 20, 1977.

The lower portion of the ring portion 22 is provided with a bracket 53 positioned to serve as a back plate to limit the inward travel of the lock 15. The outer end of the housing 48 may be cylindrical to provide a lateral support for the head of the lock and may be provided with slots 54 to receive a seal (not shown) in the usual manner to provide an indication of attempted tampering.

The ring is assembled by mounting it onto the meter ring 16 and box flange 18 and bringing the ends together so that the lock-receiving openings 32 and 46 are aligned, after which the lock 15 is inserted to lock the ends together.

To temporarily hold the ends together just prior to and during insertion of the lock, the cam surface 36 and the notch 38 are so positioned in relation to the bottom edge 56 of a slot 58 in the semicircular portion that when the ring ends are brought together, the cam surface 36 rides over the edge 56 and the notch 38 snaps onto said edge, releasably retaining the ring in the closed position with the openings 32 and 46 in alignment. Both hands are then free to assemble the lock 15.

To accomodate the slight variations in size of the ring, the meter flange, and the box flange caused by manufacturing tolerances, a leaf spring 60 may be provided on the inside surface of the ring, said spring being dimensioned to be compressed between the box and meter flanges and the ring surface when the ring is assembled.

Although in the illustrated embodiment, the ring is formed of two pieces hinged together, it will be understood that in some cases the ring may be formed of a single piece of material, with portions at the ends being added by welding or otherwise fastening as necessary.

Since certain other changes apparent to one skilled in the art may be made in the herein disclosed embodiment of the invention without departing from the scope thereof, it is intended that all matter contained herein be interpreted in an illustrative and not a limiting sense.

I claim:

1. A clamping ring for an electric meter housing or the like, said ring having adjacent end portions having lock bolt receiving apertures, said ends being movable together to align said apertures to allow a lock bolt to be inserted therein, and cooperating means on said ends which are shaped, dimensioned and positioned to automatically releasably latch together when the apertures are moved together into alignment, to retain the ends in position to receive a lock bolt into said aligned apertures.

2. A clamping ring for an electric meter housing or the like, said ring being generally circular with adjacent end portions adapted to overlap to receive a locking device, one of the portions having a housing with a cavity extending perpendicular to the plane of the ring to receive a locking bolt, said housing having a slot in the side adjacent to the other end portion, said other ring portion carrying a blade-like member which carries a lock receiving opening, said blade like member being positioned and dimensioned to enter said slot when said ring ends are moved together so that the opening in the blade-like member becomes aligned with the opening in the member carrying the housing.

3. A clamping ring as set out in claim 2 in which said ring is generally U-shaped in cross section and resilient means is disposed on the inside of the ring dimensioned to bear resiliently against the meter housing mounting ring when the ring ends are moved together.

4. A clamping ring for an electric meter housing or the like, said ring having free ends with overlapping means each of which has a lock-receiving opening, spring means on the ring positioned and adapted to resiliently bear against the meter housing when the openings are aligned, and cooperating means on the free ends of the ring to enable them to releasably lock together when the ends are moved together to align the openings to facilitate insertion of the lock.

5. A clamping ring as set out in claim 4 in which one of said free ends carries a housing disposed around the lock-receiving opening and extending forwardly from the plane of the ring, said housing being dimensioned to enclose an assembled lock.

6. A clamping ring as set out in claim 5 in which the other of said free ends has a tongue projecting therefrom positioned to extend beyond the housing when the openings are aligned, said tongue having means for snapping into engagement with a portion of said one free end.

7. A clamping ring for an electric meter housing or the like, said ring being generally circular with adjacent end portions adapted to overlap to receive a locking device, one of said ends having a housing with a cavity extending perpendicular to the plane of the ring to receive a locking bolt, said housing having an opening in the side thereof adjacent the other end of the ring, said other end having a portion having a bolt receiving aperture and being shaped and dimensioned to enter the opening in the side of the housing so that the aperture therein becomes aligned with the housing cavity, and means on the housing and said other end which are shaped, dimensioned and positioned to releasably latch together with the ends are moved together to align the aperture in said other end with the housing cavity to retain the ends in position to receive a lock bolt.

8. A clamping ring as set out in claim 7 in which said other end carries a resilient member which is shaped and positioned to snap into engagement with cooperating means associated with the housing when the apertures are aligned.

9. A clamping ring as set out in claim 8 in which said portion on said other end having the bolt receiving aperture is a blade-like member, and said resilient member is formed in the blade-like member.

* * * * *